US007318534B2

(12) United States Patent
Turvey et al.

(10) Patent No.: US 7,318,534 B2
(45) Date of Patent: Jan. 15, 2008

(54) DISPOSABLE CONTAINER COVER WITH ELASTIC REPLACEMENT

(75) Inventors: Robert R. Turvey, Sanford, MI (US); Leland J. Smith, Midland, MI (US); Kenneth S. Nurkiewicz, Racine, WI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 446 days.

(21) Appl. No.: 10/864,977

(22) Filed: Jun. 10, 2004

(65) Prior Publication Data

US 2004/0251256 A1 Dec. 16, 2004

Related U.S. Application Data

(60) Provisional application No. 60/478,702, filed on Jun. 13, 2003.

(51) Int. Cl.
*B65D 51/00* (2006.01)

(52) U.S. Cl. ..... 220/287; 220/359.2; 220/305; 220/796; 220/350

(58) Field of Classification Search ..... 220/287, 220/305, 780, 796, 790, 791–793, 350, 797, 220/9.2, 9.3, 17.3, 720, 359.1, 320; 215/275
See application file for complete search history.

(56) References Cited

U.S. PATENT DOCUMENTS 637,136 A * 11/1899 Lemmermann ..... 2/68
1,368,864 A * 2/1921 Turner ..... 2/175.6
2,064,411 A * 12/1936 Brandstein ..... 215/321
2,080,108 A * 5/1937 Brandstein ..... 215/321
2,484,340 A 10/1949 Gardner
2,490,451 A * 12/1949 Magid ..... 156/161
2,730,720 A 1/1956 Saunders
2,821,230 A * 1/1958 May ..... 150/154
2,975,931 A 3/1961 Harrison
3,095,103 A * 6/1963 Harrison ..... 215/246
3,133,656 A 5/1964 Foster
3,138,801 A * 6/1964 Brodsky ..... 2/174
3,376,995 A * 4/1968 Hunt ..... 220/200
3,587,113 A 6/1971 Harriague
3,793,110 A 2/1974 Saunders
3,852,823 A * 12/1974 Jones ..... 2/68
3,862,614 A * 1/1975 Kovac ..... 215/317
3,923,237 A 12/1975 Bostrom et al.

(Continued)

FOREIGN PATENT DOCUMENTS

EP 0119825 9/1984

(Continued)

OTHER PUBLICATIONS

International Search Report PCT/US2004/018882; report dated Dec. 9, 2004.

*Primary Examiner*—Anthony Stashick
*Assistant Examiner*—Christopher McKinley

(57) ABSTRACT

A sealable container cover includes both a flexible film and an elastic film for sealing the container cover to the wall or walls of a container. The elastic film creates an expandable opening of the container cover, which can accept containers of various sizes and shapes. Pull tabs are provided to facilitate removal of a container cover from atop a container. Also constructed in the same manner as the container covers provided herein is a container liner.

23 Claims, 6 Drawing Sheets

U.S. PATENT DOCUMENTS 4,246,945 A * 1/1981 Sterling ..... 383/43
4,542,833 A * 9/1985 DeVaughn ..... 215/319
4,560,434 A 12/1985 Sato
4,617,241 A 10/1986 Mueller
D290,678 S * 7/1987 Johnson et al. ..... D7/387
4,765,854 A 8/1988 McKeown
4,797,523 A * 1/1989 Kohnen ..... 428/131
4,844,248 A 7/1989 Forberg et al.
4,901,881 A 2/1990 McElroy
5,034,078 A 7/1991 Hodgson, Jr. et al.
5,174,658 A 12/1992 Cook et al.
5,265,278 A * 11/1993 Watanabe ..... 2/174
5,376,430 A 12/1994 Swenson et al.
5,422,172 A 6/1995 Wu
5,422,178 A 6/1995 Swenson et al.
5,462,708 A 10/1995 Swenson et al.
5,560,485 A * 10/1996 O'Hara, Jr. ..... 206/315.4
5,624,729 A 4/1997 Cohen et al.
5,641,562 A * 6/1997 Larson et al. ..... 442/394
5,695,868 A 12/1997 McCormack
5,709,312 A * 1/1998 Lake ..... 220/287
5,779,084 A * 7/1998 Lehman ..... 220/200
5,850,636 A * 12/1998 Reuven ..... 2/174
5,941,408 A 8/1999 Sherman
D423,094 S * 4/2000 Rodnell ..... D23/412
6,052,825 A 4/2000 Dodd
6,179,939 B1 1/2001 Jones, Jr. et al.
6,260,729 B1 7/2001 Mitchell et al.
6,276,551 B1 * 8/2001 Miller, II ..... 220/287
6,299,984 B1 10/2001 Forloni
6,303,208 B1 10/2001 Pelkie
6,351,852 B1 * 3/2002 Propp ..... 2/174
6,405,890 B1 6/2002 Ashley
6,440,533 B1 8/2002 Ray et al.
6,472,084 B1 10/2002 Middlesworth et al.
6,475,600 B1 11/2002 Morman et al.
6,479,154 B1 11/2002 Walton et al.
6,537,930 B1 3/2003 Middlesworth et al.
6,793,090 B2 * 9/2004 Ackerman et al. ..... 220/287
7,011,228 B2 * 3/2006 Ordiway ..... 220/287
7,051,895 B2 * 5/2006 Toussant et al. ..... 220/287
D527,455 S * 8/2006 Witt ..... D24/128
2001/0008676 A1 7/2001 Pelkie et al.
2002/0081423 A1 6/2002 Heffelfinger
2002/0146115 A1 * 10/2002 Zohn et al. ..... 379/451
2003/0082320 A1 * 5/2003 Toussant et al. ..... 428/35.2
2004/0099666 A1 * 5/2004 Ordiway ..... 220/287
2004/0099667 A1 * 5/2004 Ackerman et al. ..... 220/287
2004/0251256 A1 * 12/2004 Turvey et al. ..... 220/287
2005/0115970 A1 * 6/2005 Watson ..... 220/287
2006/0207712 A1 * 9/2006 Toussant et al. ..... 156/69

FOREIGN PATENT DOCUMENTS

EP 0119827 9/1984
FR 852 181 A 1/1940
JP 2000238902 A * 9/2000
WO WO-99/50153 10/1999

* cited by examiner

DISPOSABLE CONTAINER COVER WITH ELASTIC REPLACEMENT

CROSS REFERENCE TO RELATED APPLICATION

This application is related to, and claims the priority benefit of, U.S. Provisional Patent Application No. 60/478,702, filed Jun. 13, 2003.

FIELD OF THE DISCLOSURE

The present disclosure generally relates to disposable container covers. More particularly, the present disclosure relates to disposable container covers having elastic sealing apparatus.

BACKGROUND OF THE DISCLOSURE

Disposable container covers capable of covering containers of various sizes and shapes have been in use for many years. Such covers typically include a plastic film, such as polyethylene, provided in sufficient dimension to overlie the container opening. The film then employs surface tension or elastic bands to secure the film to the container, such as with Saran® wrap or Quick Covers®, respectively, both being products of the present assignee, with the latter having an elastic band sewn directly to the film around its perimeter. The elastic band bordering the film is attached in such a manner that tension is created on the film, thereby creating a hollow enclosure with an expandable opening for placing atop and around containers of various sizes and shapes.

Use of such container covers is common for both perishable and nonperishable items. While these covers are beneficial in many respects, they are not without room for improvement. A common problem with existing container covers is the lack of an effective seal between the cover and the container. This is especially problematic with regard to food storage. First, depending on the size of the container cover relative to the container, the conventional container covers described above are vulnerable to slippage and inadvertent removal from the container. Any attempt at preserving freshness or protecting the contents of the container from exposure to various elements is futile where the container cover does not actually cover the container, but instead, slips off the container.

Even when such conventional covers remain appropriately positioned on a container, their sealing capabilities are limited. More specifically, given the limited constriction afforded by elastic bands, the susceptibility of films to lose surface tension, and/or the irregular shapes of the containers being sealed, air and moisture can flow relatively freely in and out of containers covered with conventional container covers. Consequently, where a substantial or hermetic seal is desired, as opposed to where air or moisture ventilation is desired, the goal of preserving the freshness of perishable items is less likely to be realized with conventional disposable covers.

An additional problem with conventional container covers relates to manufacturing. Specifically, conventional container covers, as described above, require the slow, labor intensive manufacturing step of manually sewing an elastic band to the periphery of the film. These covers do not readily lend themselves to high-speed automated manufacturing, in turn, driving up the cost and time of manufacturing conventional container covers.

SUMMARY OF THE DISCLOSURE

In accordance with one aspect of the disclosure, a container cover is provided which comprises a flexible film having an elastic film attached at the periphery of the flexible film. In accordance with another aspect of the disclosure, a container cover is provided which comprises flexible pull tabs, positioned to allow for easy removal of the container cover from atop a container. In accordance with yet additional aspects of the disclosure, container covers are provided wherein a foam or thinsulate material is bonded to the flexible film, providing a means maintaining the temperature of the container's contents.

Further provided by the present disclosure is a disposable container liner comprised of a flexible film having an elastic film attached at the periphery of the flexible film.

These and other aspects and features of the disclosure will become more apparent from the following detailed description when taken in conjunction with the accompanying drawings.

Figure 1A:
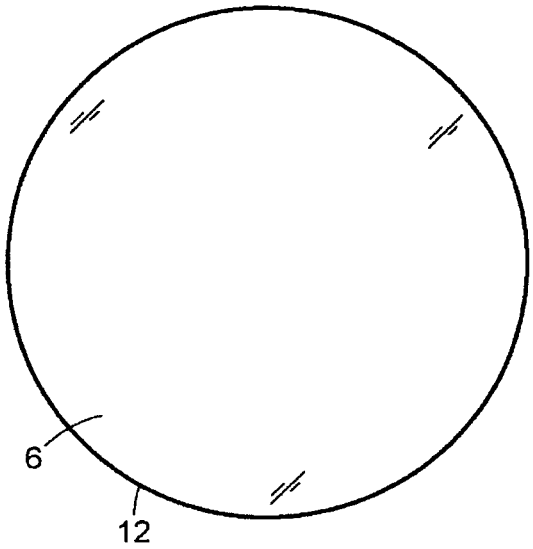
FIG. 1A is a plan view of a round-shaped flexible film for construction of a container cover in accordance with the teachings of the present disclosure.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and equivalents falling within the spirit and scope of the disclosure.

DETAILED DESCRIPTION OF THE DISCLOSURE

Referring now to the drawings, and with specific reference to FIGS. 1A-1D, a container cover constructed in accordance with the present disclosure is generally referred to by reference numeral 10. While the container cover 10 will be described herein with reference to food storage covers for covering containers 18 such as bowls, pots, and pans, it is to be understood that the teachings of the disclosure could be employed for any type of cover, such as, but not limited to, covers used to store perishable goods other than food, as well as, covers for nonperishable goods. Furthermore, while the container cover 10 depicted is constructed using thermoplastic film, such as polyethylene, also embodied by the present disclosure is the use of any flexible film including, but not limited to, other polymers, waxed paper, metallic foil, parchment paper, and the like. In addition, the film from which the container cover 10 is constructed can be perforated, thereby allowing for air and moisture flow through the container cover 10. This characteristic is oftentimes desired, for example, when storing fruit and/or vegetables.

Figure 1B:
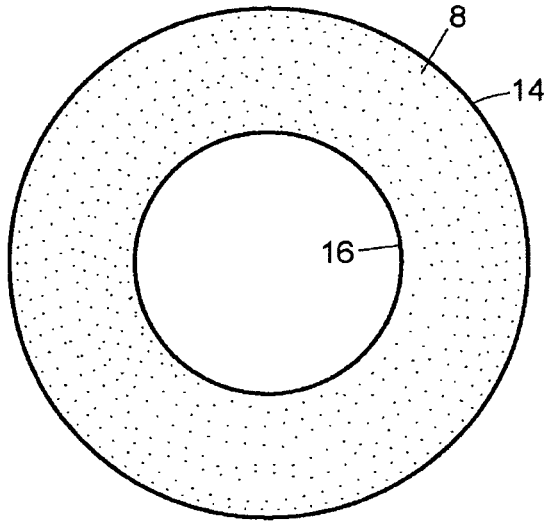
FIG. 1B is a plan view of a round-shaped elastic film for use in combination with the flexible film of FIG. 1A in constructing a container cover in accordance with the teachings of the present disclosure.
Figure 1C:
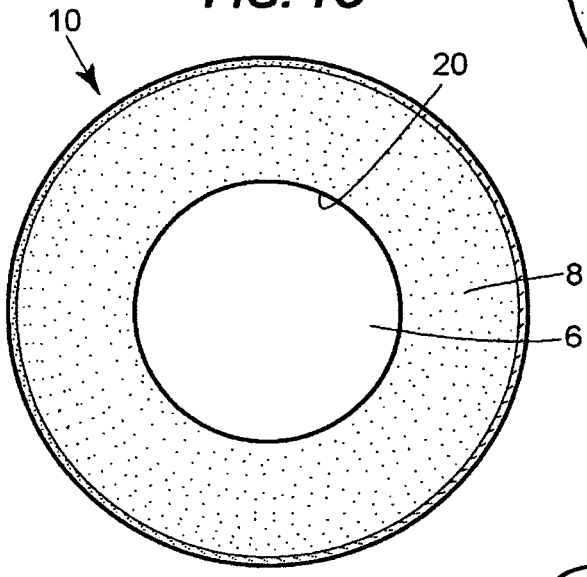
FIG. 1C is a bottom view of a round container cover constructed from the flexible and elastic films of FIGS. 1A and 1B, depicted in a relaxed state.
Figure 1D:
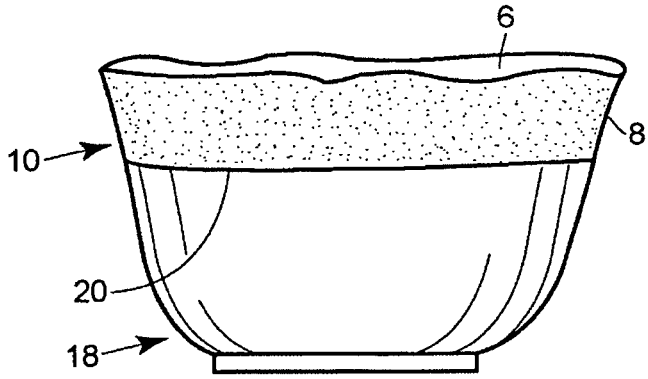
FIG. 1D is a plan view of a typical round container utilizing a container cover constructed in accordance with the teachings of the present disclosure.

FIG. 1A illustrates a solid, round flexible film 6 for use in combination with an annular elastic film 8, as depicted in FIG. 1B. In accordance with the present disclosure, the annular elastic film 8 is edge-welded, or otherwise attached, at the periphery 12 of the flexible film 6 to create a container cover 10 as depicted in FIGS. 1C and 1D. One with skill in the art would understand the teachings of the present invention to include attachment of the elastic film 8 to the flexible film 6 via ultrasonic welding, adhesive, heat stamping, or hot wire fusion. One skilled in the art would also understand elastic films to include, for example, Product CEX-816WR and Product X-25132, both of which are manufactured by Tredegar Films. In addition, Dow Chemical manufactures a number of elastic films that could be employed in the present disclosure, including: Polyolefin Plastomers 8200 and PF 1140 Series, and Flexomer 9078 Series. Alternatively, the elastic film of the present invention could be replaced with a heat or water shrinkable film. Such films, upon the application of heat, water, or moisture vapor, shrink in size and yield an elasticized film.

In the illustrated embodiment of FIGS. 1A-1D, the circumference of the flexible film 12 is the same as the outer circumference 14 of the elastic film 8. In another embodiment, the inner circumference 16 of the elastic layer is smaller than the opening of the container 18 for which the container cover 10 is intended to accept. FIGS. 1C and 1D illustrate a container cover 10 in two different orientations: relaxed and normal usage, respectively. As will be described in further detail herein, the elastic film 8 bordering the flexible film 6 is attached in such a manner that an expandable opening 20 in the in the container cover 10 is created, as shown best in FIGS. 1C and 1D. In this manner of construction, the container cover 10 defines a hollow body of flexible film 6 with an expandable opening 20 capable of covering containers 18 of various sizes and shapes. As best illustrated in FIG. 1D, when the container cover 10 is secured on top of a container 18, the flexible film 6 is positioned primarily over the container's 18 opening, while the elastic film 8 is positioned primarily around the upper edge of the container, thereby securing the container cover 10 to the container 18. There are numerous options for positioning the container cover on top of a container, the optimal position depending on, for example, the particular size and shape of the container, and the contents of the container. In addition, the container cover may be provided with a means for releasing excess pressure, such as air confined beneath the container cover. This means may include, a pressure sensitive hole that can be activated by the user. Alternatively, the means may include a tab or handle that can be manipulated to facilitate the release of excess air from beneath the container cover, a process commonly referred to as "burping" the container to effect a seal.

Figure 2A:
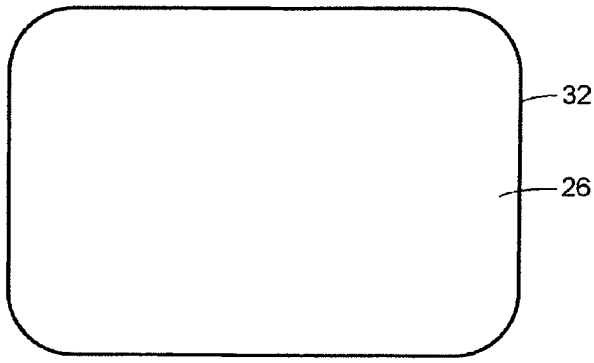
FIG. 2A is a plan view of a rectangular-shaped flexible film for construction of a container cover in accordance with the teachings of the present disclosure.
Figure 2B:
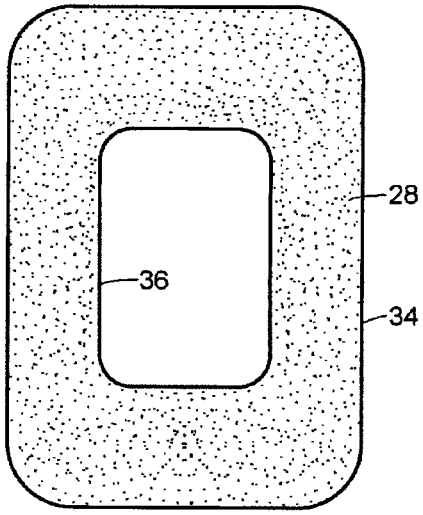
FIG. 2B is a plan view of a rectangular-shaped elastic film for use in combination with the flexible film of FIG. 2A in constructing a container cover in accordance with the teachings of the present disclosure.
Figure 2C:
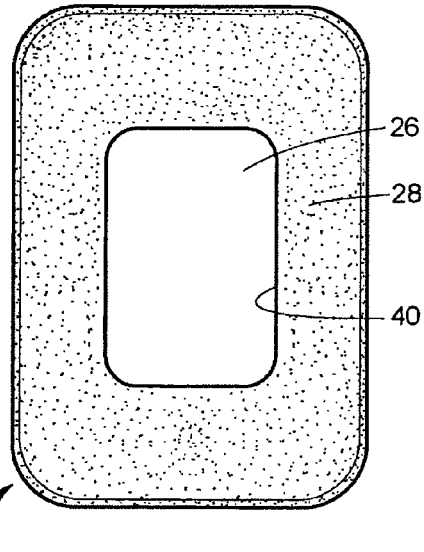
FIG. 2C is a bottom view of a rectangular container cover constructed from the flexible and elastic films of FIGS. 2A and 2B, depicted in a relaxed state.
Figure 2D:
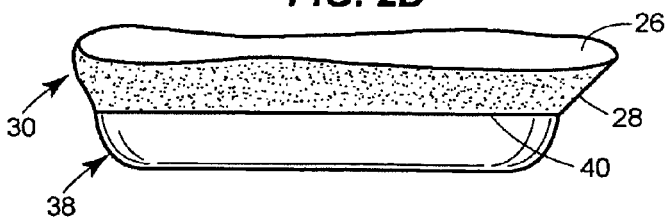
FIG. 2D is a plan view of a rectangular container utilizing a container cover constructed in accordance with the teachings of the present disclosure.

While the container cover illustrated by FIGS. 1A-1D is round in shape, container covers of the present disclosure can be constructed in various shapes, including, but not limited to, rectangular, square, or trapezoidal in shape. A rectangular-shaped embodiment of the present disclosure is illustrated in FIGS. 2A-2D. With the exception of the shape, the container cover of FIGS. 2A-2D parallel that of FIGS. 1A-1D in both characterization and construction. Specifically, a solid, rectangular-shaped flexible film 26 and a rectangular-shaped elastic film 28, having an outer perimeter 34 and an inner perimeter 36 are provided. The flexible film 26 and the elastic film 28, having the same sized and shaped perimeter 32 and outer perimeter 34, respectively, are edge-welded, or otherwise attached, together at the peripheries 32, 34 to create a rectangular-shaped container cover 30. FIGS. 2C and 2D illustrate a container cover 30 in two different orientations: relaxed and normal usage, respectively. The container cover 30 is characterized further as having an expandable opening 40, thereby allowing for coverage of containers of various shapes and sizes. As best illustrated in FIG. 2D, when the container cover 30 is secured on top of a container 38, the flexible film 26 is positioned primarily over the container's 38 opening, while the elastic film 28 is positioned primarily around the upper edge of the container, thereby securing the container cover 30 to the container 38.

Figure 3A:
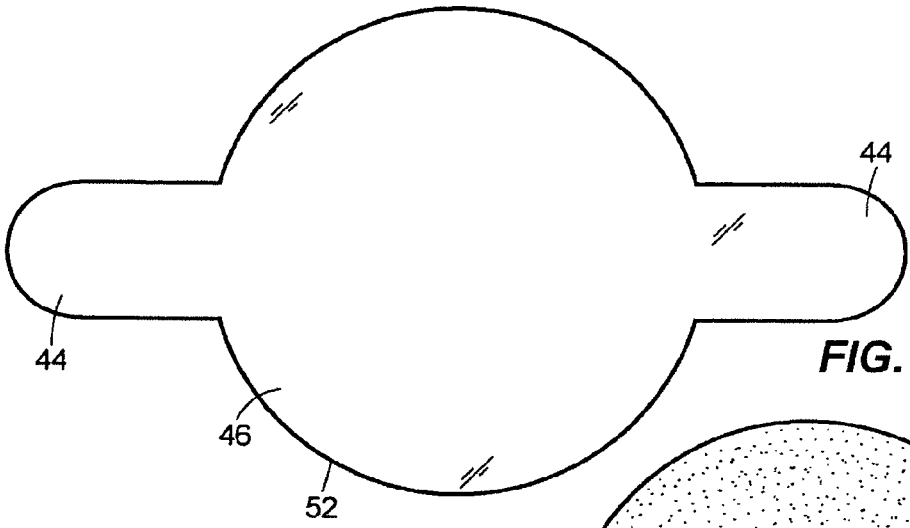
FIG. 3A is a plan view of a round-shaped flexible film provided with pull tabs for construction of a container cover in accordance with the teachings of the present disclosure.
Figure 3B:
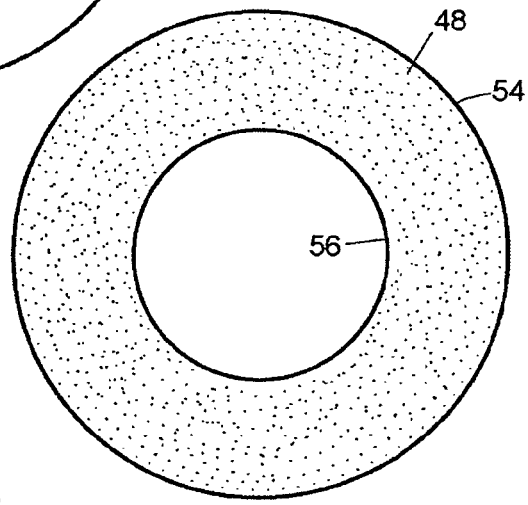
FIG. 3B is a plan view of a round-shaped elastic film for use in combination with the flexible film of FIG. 3A in constructing a container cover having pull tabs in accordance with the teachings of the present disclosure.
Figure 3C:
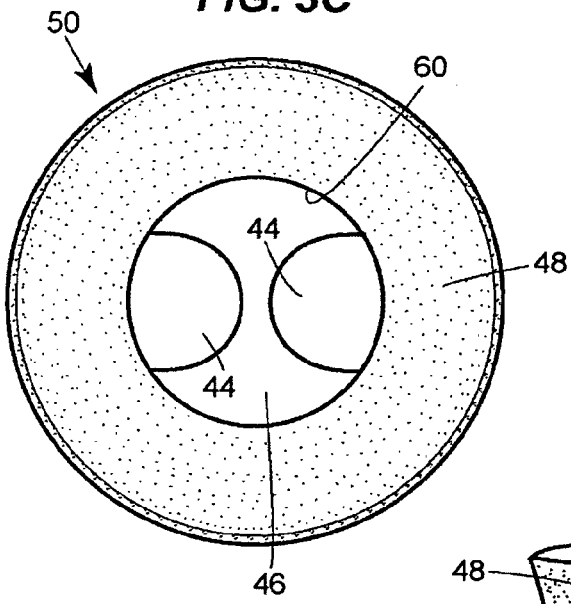
FIG. 3C is a bottom view of a round container cover having pull tabs and constructed from the flexible and elastic films of FIGS. 3A and 3B, depicted in a relaxed state.
Figure 3D:
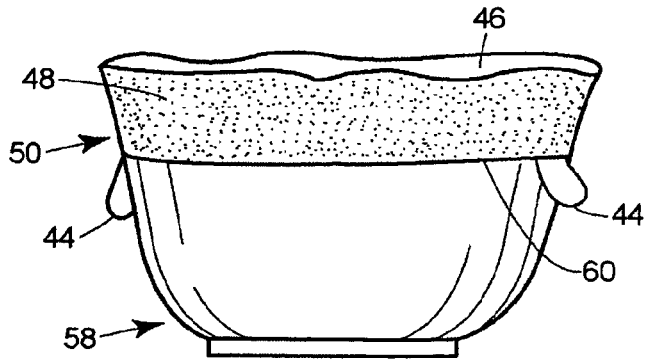
FIG. 3D is a plan view of a typical round container utilizing a container cover having pull tabs and constructed in accordance with the teachings of the present disclosure.

As depicted in FIGS. 3A-3D, a container cover of the present disclosure may further include pull tabs to aid in the removal of the container cover from atop a container. With the exception of the addition of the pull tabs, FIGS. 3A-3D parallel FIGS. 1A-1D in characterization and construction. Specifically, FIG. 3A illustrates a solid, substantially round flexible film 46 for use in combination with an annular elastic film 48, as depicted in FIG. 3B. While the flexible film 6 of FIG. 1A is round, the flexible film 46 of FIG. 3A includes a perimeter 52 that is only substantially round due to the addition of pull tabs 44 on opposite sides of the flexible film 46. The pull tabs 44 of container cover 50 are best illustrated in FIGS. 3C and 3D. During manufacture, the pull tabs 44 of the flexible film are folded over just prior to attaching the periphery of the annular elastic film 48 to the periphery of the flexible film 46. Specifically, the annular elastic film 48, having the same outer circumference 54 as the circumference 52 of the substantially round flexible film 46 (after the folding of the pull tabs 44), is edge-welded, or otherwise attached, at the periphery of the flexible film 46 to create a container cover 50 like that of FIGS. 3C and 3D.

FIGS. 3C and 3D illustrate the container cover 50 in two different orientations: relaxed and normal usage, respectively. As shown in FIG. 3D, the pull tabs 44 extend down, and out, from under the periphery of the elastic film 48 once placed atop a container 58. The pull tabs 44 extending down are sufficient in size to allow the user to grasp a pull tab 44 and pull in an upwardly direction, thereby removing the container cover 50 from the container 58. As with the above-described embodiments, the container cover 50 is characterized further as having an expandable opening 60, thereby allowing for coverage of containers of various shapes and sizes. As best illustrated in FIG. 3D, when the container cover 50 is secured on top of a container 58, the flexible film 46 is positioned primarily over the container's 58 opening, while the elastic film 48 is positioned primarily around the upper edge of the container, thereby securing the container cover 50 to the container 58.

Figure 4:
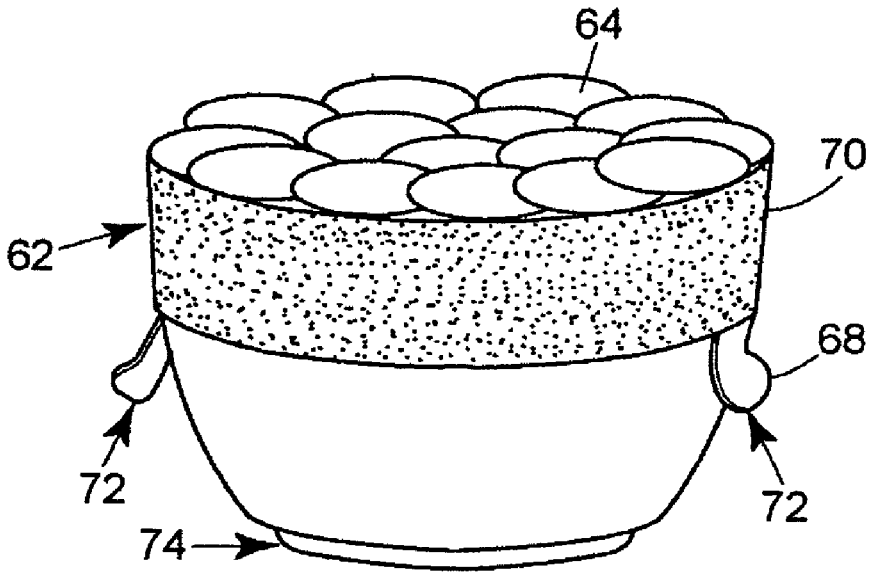
FIG. 4 is a plan view of a typical round container utilizing a container cover having insulation and pull tabs, constructed in accordance with the teachings of the present disclosure.

FIG. 4 illustrates another embodiment of the container cover 62 of the present invention in a normal usage state. This particular embodiment of the container cover 62 includes, in addition to the features described with reference to FIGS. 3A-3D, an insulated material 64 welded, or otherwise attached, to the flexible film 68. Specifically, the embodiment of FIG. 4 includes a flexible film 68 to which the insulated material 64 and the elastic film 70 are attached, and from which the pull tabs 72 are constructed. The flexible film 68 and the insulated material 64 are attached by, for example, a heat seal or an adhesive. The insulated material 64 functions to help maintain the temperature of the contents within the container, and may be a thinsulate material, for example, 3M Thinsulate®. Other forms of insulative material known to those with skill in the art are available for use in this embodiment. In a preferred embodiment, and as illustrated in FIG. 4, the container cover 62 is secured on top of a container 74, such that the flexible film 68 having the insulated material 64 welded thereto is positioned primarily over the container's 74 opening, while the elastic film 70 is positioned primarily around the upper edge of the container, thereby securing the container cover 62 to the container 74. In this manner of construction, the flexible film 68 serves as a barrier between the insulated material 64 and the contents of the container 74.

Figure 5:
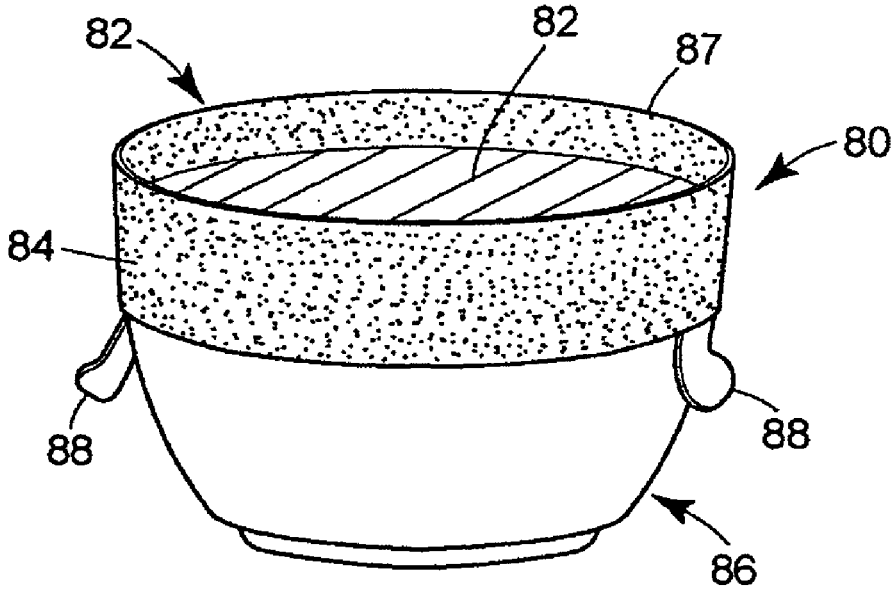
FIG. 5 is a plan view of a typical round container utilizing a container liner having pull tabs and constructed in accordance with the teachings of the present disclosure.

FIG. 5 illustrates an additional embodiment of the present disclosure, wherein a container liner 80 is provided. The construction of the container liner 80 is essentially the same as the container cover 50 described above with reference to FIGS. 3A-3D, but includes additional film 82 sufficient in dimension to cover or line the entire inner surface of a container 86. For ease of illustration, the liner 80 is depicted in FIG. 5 as extending across a mid-section of the container, a relatively short distance from the container rim 87. It is to be understood, however, that the liner 80 could extend into the entire depth of the container 86 and lay against the entire inner surface thereof. Therefore, this embodiment differs from the embodiment illustrated in FIGS. 3A-3D in that the flexible film 82 in FIG. 5 lines the container 86 rather than covering the opening of the container 86. As such, the container is protected from the contents of the container, rather than the contents of the container being protected from exposure to various external elements. Like the above-described container covers 10, 30, 50, the container liner illustrated in FIG. 5 is constructed from a round, solid flexible film 82 having an annular elastic film 84 edge-welded thereto. The flexible film 82 for lining the container 86 may be provided in different sizes and shapes depending on the container to be lined. The particular embodiment of FIG. 5 is also provided with pull tabs 88 that extend down, and out, from under the elastic film 84, thereby facilitating the removal of the liner 80 from the container 86. As also illustrated in FIG. 5, when the container liner 80 is secured to a container 86, the flexible film 82 is positioned inwardly from the container's 86 opening, thereby lining the interior of the container, while the elastic film 84 is positioned primarily around the upper edge of the container, thereby securing the liner 82 to the container 86.

Figure 6:
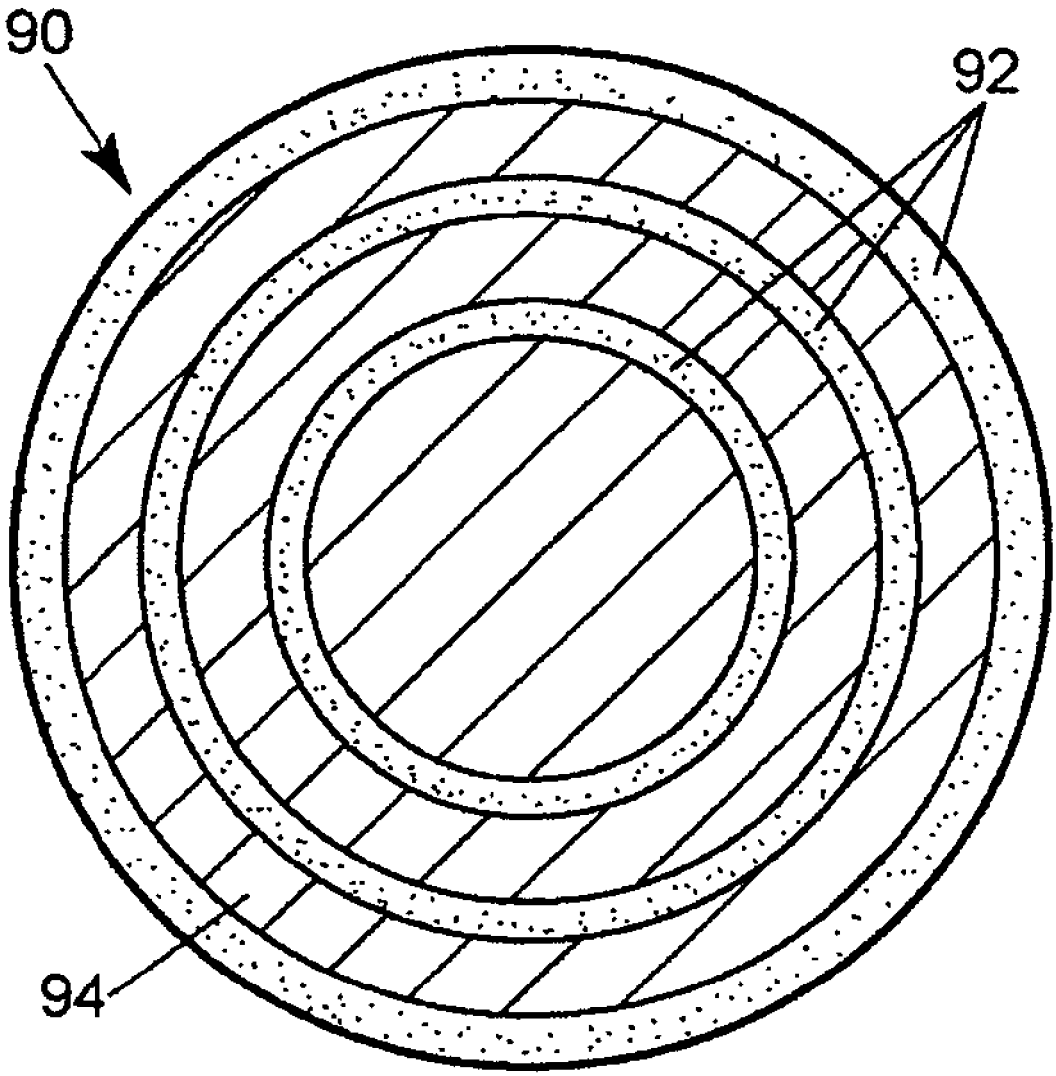
FIG. 6 is a bottom view of a container cover having multiple annular elastic films or rings and constructed in accordance with the teachings of the present disclosure.

Further provided by the present disclosure, and illustrated in FIG. 6, is a container cover 90 having multiple sized annular elastic films or elastic rings 92 attached to a flexible film 94. The elastic films 92 serve as sealing rings for securing the container cover 90 to a container. As with the above-described embodiments, the multiple elastic films 92 of this embodiment may be edge-welded, or otherwise attached, to a flexible film 94. The elastic films or rings 92 function in the same manner as the elastic film describe with reference to FIGS. 1-5. However, the incorporation of multiple sized elastic films 92 in this particular embodiment allow the container cover 90 to accept a greater variety of containers, in terms of sizes and shapes.

Figure 7:
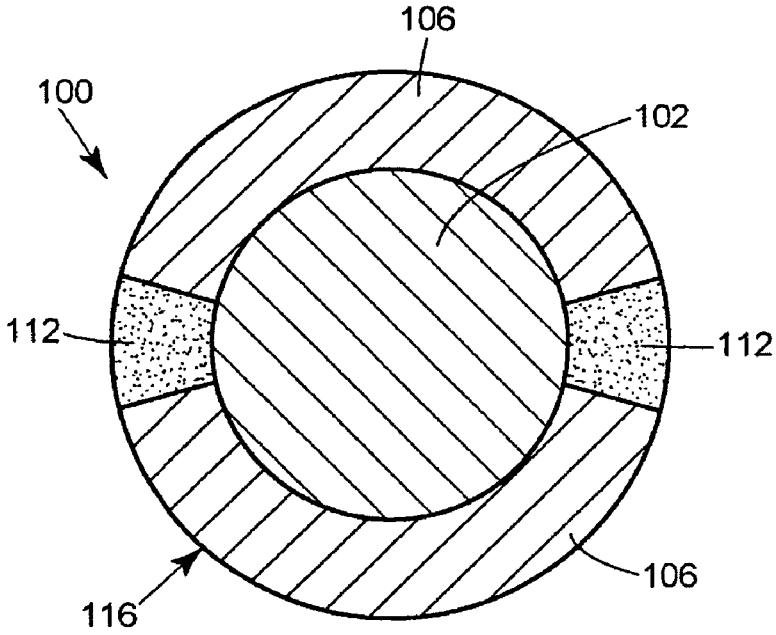
FIG. 7 is a bottom view of a round container cover having a bottom layer formed from two sections of elastic film and two sections of flexible film.
Figure 8:
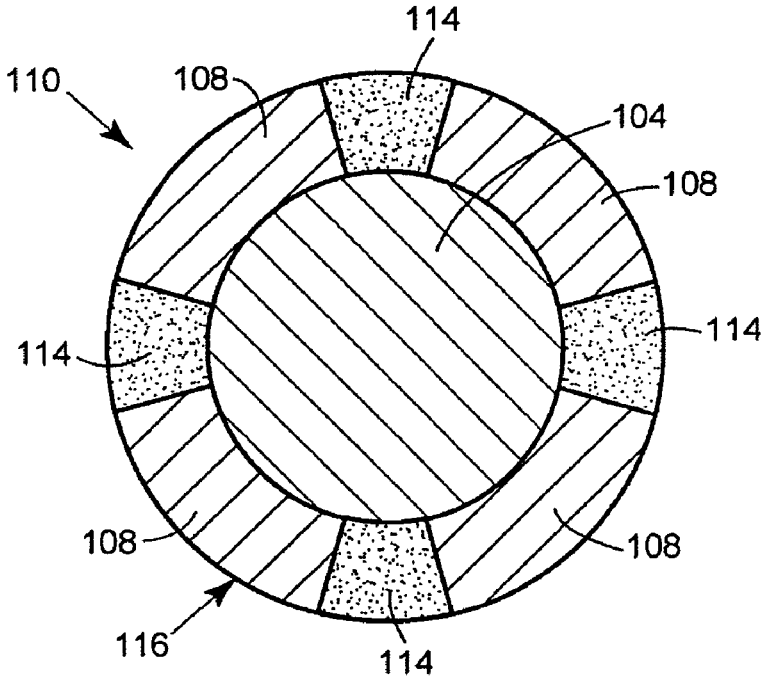
FIG. 8 is a bottom view of a round container cover having a bottom layer formed from four sections of elastic film and four sections of flexible film.

FIGS. 7 and 8 illustrate additional embodiments of the present disclosure, wherein the elastic film is placed intermittently around the container cover. Specifically, the embodiments of FIGS. 7 and 8 include a container cover 100, 110 having a top layer of flexible film 102, 104 and a bottom layer of individual sections of flexible film 106, 108 separated by individual sections of elastic film 112, 114. The bottom layer is created by welding the individual sections of elastic film 112, 114 and the individual sections of flexible film 106, 108 together to create an annular shape. As illustrated in FIG. 7, two sections of flexible film 106 are separated by two sections of elastic film 112 positioned on opposite sides of the bottom annular layer. Alternatively, as depicted in FIG. 8, the bottom layer may consist of four sections of flexible film 108 separated by four sections of elastic film 114, each at 90° intervals around the bottom annular layer. Also embodied by the present disclosure is any positioning of one or more elastic layers 112, 114 combined with one or more flexible layers 106, 108 to form the bottom layer.

Like the container covers described above with reference to FIGS. 1-5, the container covers 100, 110 of FIGS. 7 and 8 include two layers having the same size and shape perimeters 116, which are edge-welded, or otherwise attached, at their perimeters 116 to form the container covers 100, 110. One of skill in the art would understand the teachings of the present invention to include attachment of the bottom and top layers via ultrasonic welding, adhesive, heat stamping, or hot wire fusion. Further, the container covers 100, 110 of FIGS. 7 and 8 may be positioned on top of a container such that the top layer of flexible film 102, 104 is positioned primarily over a container's opening, while the bottom layer of elastic 112, 114 and flexible film 106, 108 is positioned primarily around the upper edge of the container, thereby securing the container cover 100, 110 to the container. As with all embodiments of the present disclosure, the container covers 100, 110 of FIGS. 7 and 8 may be provided with pull tabs to facilitate removal of the container covers 100, 110 from atop a container.

Also provided by the present disclosure is a method of covering a container using the container covers described above and illustrated by FIGS. 1-8. With reference to FIG. 3D, for example, by expanding the opening 60 of the cover 50 created by the elastic film 48 to the appropriate size for a given container 58, the user can position the cover 50 around the opening of the container 58. With the elastic material 48 so surrounding the wall of the container 58, the user can then release the flexible film 48 so that the elastic film 48 forms a seal against the outside of the container 58.

As described above with reference to FIG. 3D, an additional embodiment of the disclosure provides for pull tabs 44 extending down, and out, from under the elastic film 46 of the container cover 50. The pull tabs 44 facilitate removal of the container cover 50 from atop the container 58. Accordingly, the present disclosure also provides a method of removing the above-described container covers from a container by grasping one or both of the pull tabs 44 and pulling in the upward direction, while also grasping the container 58 (if necessary).

While certain representative embodiments and details have been shown for purposes of illustrating the disclosure, it will be apparent to those skilled in the art that various changes in the methods and apparatus disclosed herein may be made without departing from the scope of the disclosure.

What is claimed is:

1. A container cover, comprising:

a flexible film having an outer surface and an inner surface;

a first annular elastic film coupled to the flexible film proximate a periphery of the flexible film; and a second annular elastic film coupled to the inner surface of the flexible film, interior to the first elastic film, the second elastic film being made of the same material as the first elastic film and having the same elasticity as the first elastic film, wherein the elastic films are a material selected from the group consisting of polyolefin plastomer, polyethylene-based elastomer, olefinic elastomer, polyurethane film, very low density polyethylene, ethylene propylene rubber with ethylene vinyl acetate extruded into a film, plasticized vinyl chloride, and ethylene propylene rubber.

2. The container covet of claim 1, further comprising a third elastic film coupled to the inner surface of the flexible film, interior to the second elastic film.

3. The container cover of claim 1, wherein the flexible film is a thermoplastic material.

4. The container cover of claim 1, wherein the flexible film is a material selected from the group consisting of thermoplastic, polymer, waxed paper, metallic foil, and parchment paper.

5. The container cover of claim 1, wherein the elastic films arc polyolefin plastomers.

6. The container cover of claim 1, wherein the elastic films are heat shrinkable films.

7. The container cover of claim 1, wherein the elastic films are water or vapor shrinkable films.

8. The container cover of claim 1, wherein the flexible film is perforated.

9. The container cover of claim 1, wherein the periphery of the flexible film is round.

10. The container cover of claim 1, wherein the elastic films are edge-welded to the flexible film.

11. The container cover of claim 1, wherein the flexible film comprises a user-activated vent.

12. The container cover of claim 1, wherein an insulated material is coupled to the outer surface of the flexible film.

13. The container cover of claim 1, wherein the flexible film comprises pull-tabs, the pull-tabs extending from the periphery of the flexible film.

14. A container liner, comprising:

a flexible thermoplastic film having a planar configuration;

a first annular; elastic film coupled to the flexible film proximate a periphery of the flexible film, the elastic film being coplanar with the flexible film;

a ring of flexible film radially inward of and attached to the first annular elastic film; and a second annular, elastic film radially inward of and attached to the ring of flexible film, the second annular elastic film being made of the same material as the first elastic film and having the same elasticity as the first annular, elastic film, wherein the elastic film is a material selected horn the group consisting of polyolefin plastomer, polyethylene-based elastomer, olefinic elastomer, polyurethane film, very low density polythylene, ethylene propylene rubber with ethylene vinyl acetate extruded into a film, plasticized vinyl chloride, and ethylene propylene rubber.

15. The container liner of claim 14, wherein the flexible film is a material selected from the group consisting of thermoplastic, polymer, waxed paper, metallic foil, and parchment paper.

16. The container liner of claim 14, wherein the elastic film is a polyolefin plastomer.

17. The container liner of claim 14, wherein the elastic film is a heat shrinkable film.

18. The container liner of claim 14, wherein the elastic film is a water or vapor shrinkable film.

19. The container liner of claim 14, wherein the flexible film is perforated.

20. The container liner of claim 14, wherein the periphery of the flexible film is round.

21. The container liner of claim 14, wherein the elastic film is edge-welded to the flexible film.

22. The container liner of claim 14, wherein the flexible film comprises pull-tabs, the pull-tabs extending from the periphery of the flexible film.

23. The container liner of claim 14, wherein the elastic film is coupled continuously along the periphery of the flexible film.

* * * * *